US007081023B2

(12) United States Patent
Zhang et al.

(10) Patent No.: US 7,081,023 B2
(45) Date of Patent: Jul. 25, 2006

(54) MULTI-FUNCTION JACK CONNECTOR

(75) Inventors: Guohua Zhang, Kunsan (CN); HongQiang Han, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/899,604

(22) Filed: Jul. 26, 2004

(65) Prior Publication Data

US 2005/0020140 A1 Jan. 27, 2005

(30) Foreign Application Priority Data

Jul. 25, 2003 (TW) ..... 92213600 U

(51) Int. Cl.
*H01R 24/04* (2006.01)

(52) U.S. Cl. ..... 439/668; 439/577; 385/75

(58) Field of Classification Search ..... 439/668, 439/669, 577, 344; 385/88, 89, 75
See application file for complete search history.

(56) References Cited

U.S. PATENT DOCUMENTS 4,547,039 A * 10/1985 Caron et al. ..... 385/88
6,238,249 B1 * 5/2001 Kuwamura ..... 439/668
6,475,001 B1 * 11/2002 Ohbayashi et al. ..... 439/83
6,588,947 B1 * 7/2003 Mine et al. ..... 385/92
6,790,095 B1 * 9/2004 Liu ..... 439/668
6,887,111 B1 * 5/2005 Nakai et al. ..... 439/669
6,918,799 B1 * 7/2005 Zhu et al. ..... 439/862
2005/0100285 A1 * 5/2005 Han et al. ..... 385/75
2005/0105856 A1 * 5/2005 Han et al. ..... 385/75

* cited by examiner

*Primary Examiner*—Hae Moon Hyeon
(74) *Attorney, Agent, or Firm*—Wei Te Chung

(57) ABSTRACT

A jack (1) connector comprises an insulating housing (10), a plurality of different contacts (21), (22), (23), (24), and an optical device (30). The insulative housing comprises a mating portion (11), a mounting portion (12), side portions (13), and a cavity space (14). The mating portion defines an opening (111) extending therethrough and communicating with the cavity space. The contacts are retained in the insulative housing, each contact having an upper end received in the cavity space and a tail end. The optical device is installed in the insulative housing and has an engaging portion for contacting an optical fiber plug connector, and a number of tail portions. A first distance between the engaging portion and the mating portion is longer than a second distance between the upper end of the contact and the mating portion.

8 Claims, 4 Drawing Sheets

1

MULTI-FUNCTION JACK CONNECTOR

BACKGROUND OF THE INVENTION

1. Field of the Invention

The present invention generally relates to an electrical connector, and more particularly to a multi-function jack connector which can mate with an audio plug or an optical fiber mating plug connector.

2. Description of Related Art

Audio Jack connectors are commonly used in consumer electronic products for transmitting signals. U.S. Pat. No. 4,393,283 discloses basic structures of an audio jack. With the development of the optical fiber communication, especially in high speed regional networks, requirements of optical fiber connectors are growing. It is known to apply the optical fiber connectors in video and voice devices. U.S. Pat. No. 2002/0191921 A1 discloses basic structures of an optical fiber connector. In order to adapt to miniaturizing trends and achieve multi-function purpose of the connector, there will be a change to recombine different functions in the same connector. In prior arts, a stacked or an abreast audio jack can not achieve the purpose of multi-function.

Hence, a multi-function jack connector is desired to overcome the disadvantages of the related art.

BRIEF SUMMARY OF THE INVENTION

Accordingly, it is an object of the present invention to provide a jack connector which can receive an audio plug or optical fiber mating plug connector for achieving a multi-function purpose.

In order to achieve the above-mentioned object, a jack connector in accordance with the present invention comprises an insulating housing, a plurality of different contacts, and an optical device.

The insulative housing comprises a mating portion, a mounting portion, side portions, and a cavity space. The mating portion defines an opening extending therethrough and communicating with the cavity space. The contacts are retained in the insulative housing. Each contact has an upper end received in the cavity space and a tail end. The optical device is installed in the insulative housing and has an engaging portion for contacting an optical fiber plug connector and a number of tail portions. A first distance between the engaging portion and the mating portion is longer than a second distance between the upper end of the contact and the mating portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
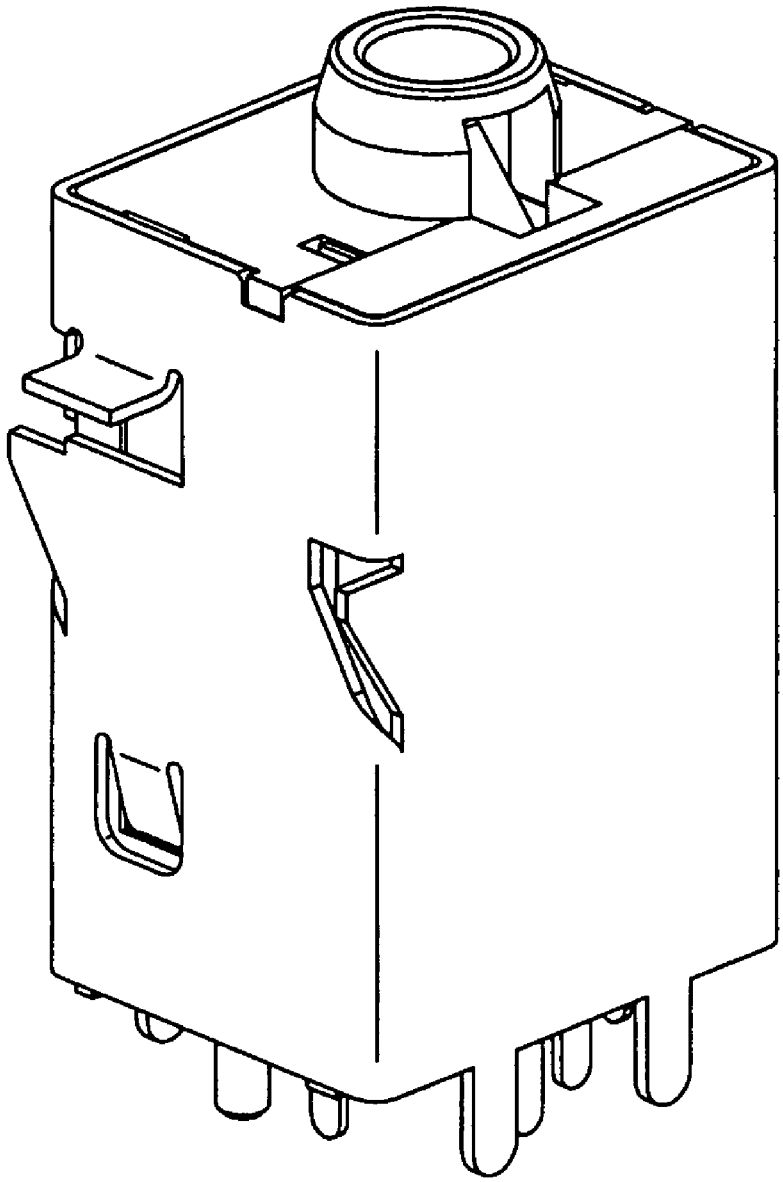
FIG. 1 is an assembled, perspective view of a jack connector in accordance with the present invention.

Reference will now be made to the drawing figures to describe the present invention in detail.

Figure 2:
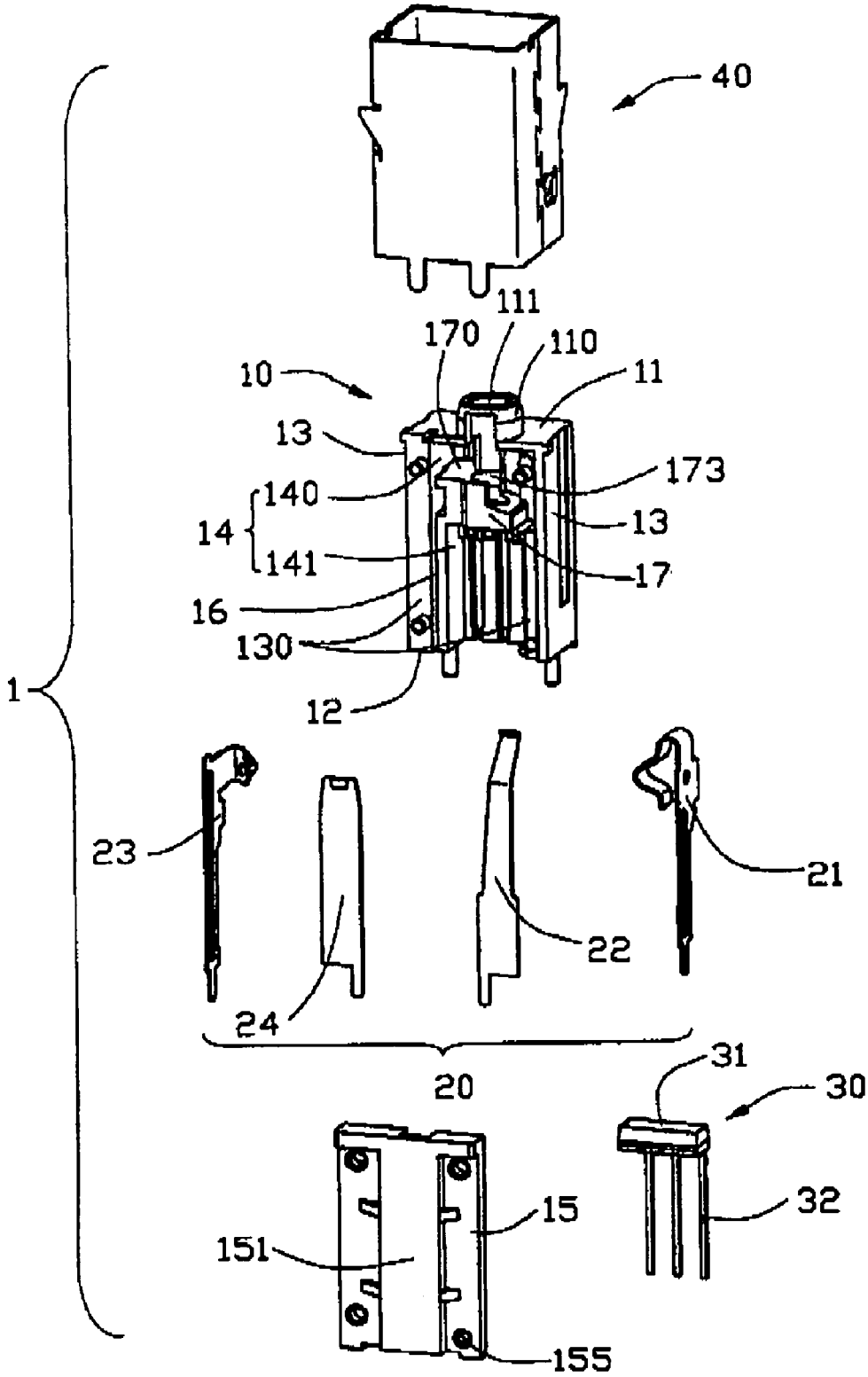
FIG. 2 is an exploded, perspective view of the jack connector of FIG. 1.
Figure 3:
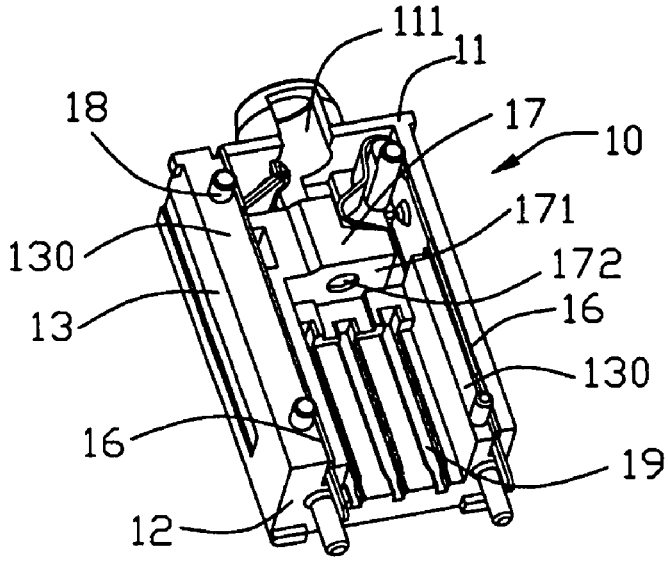
FIG. 3 is a partly assembled, perspective view of an insulative housing.
Figure 4:
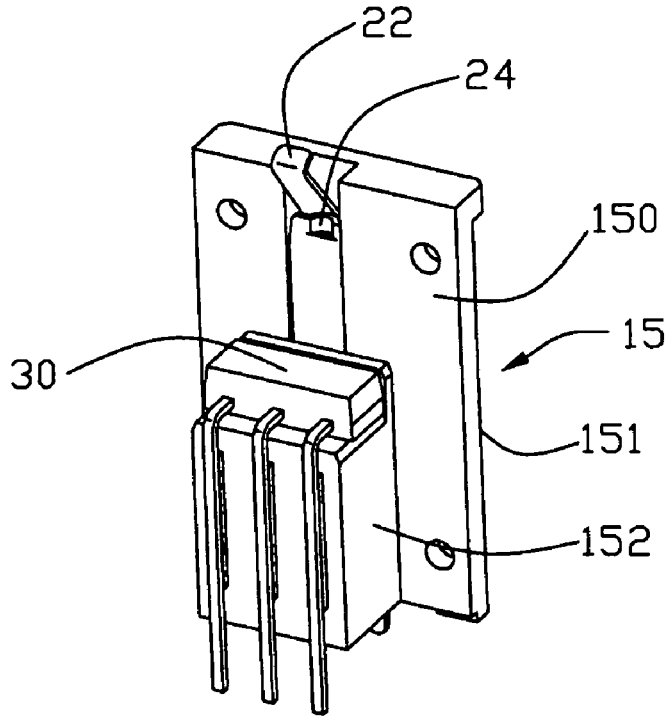
FIG. 4 is an assembled, perspective view of a spacer, an optical device, and contacts of FIG. 2.
Figure 5:
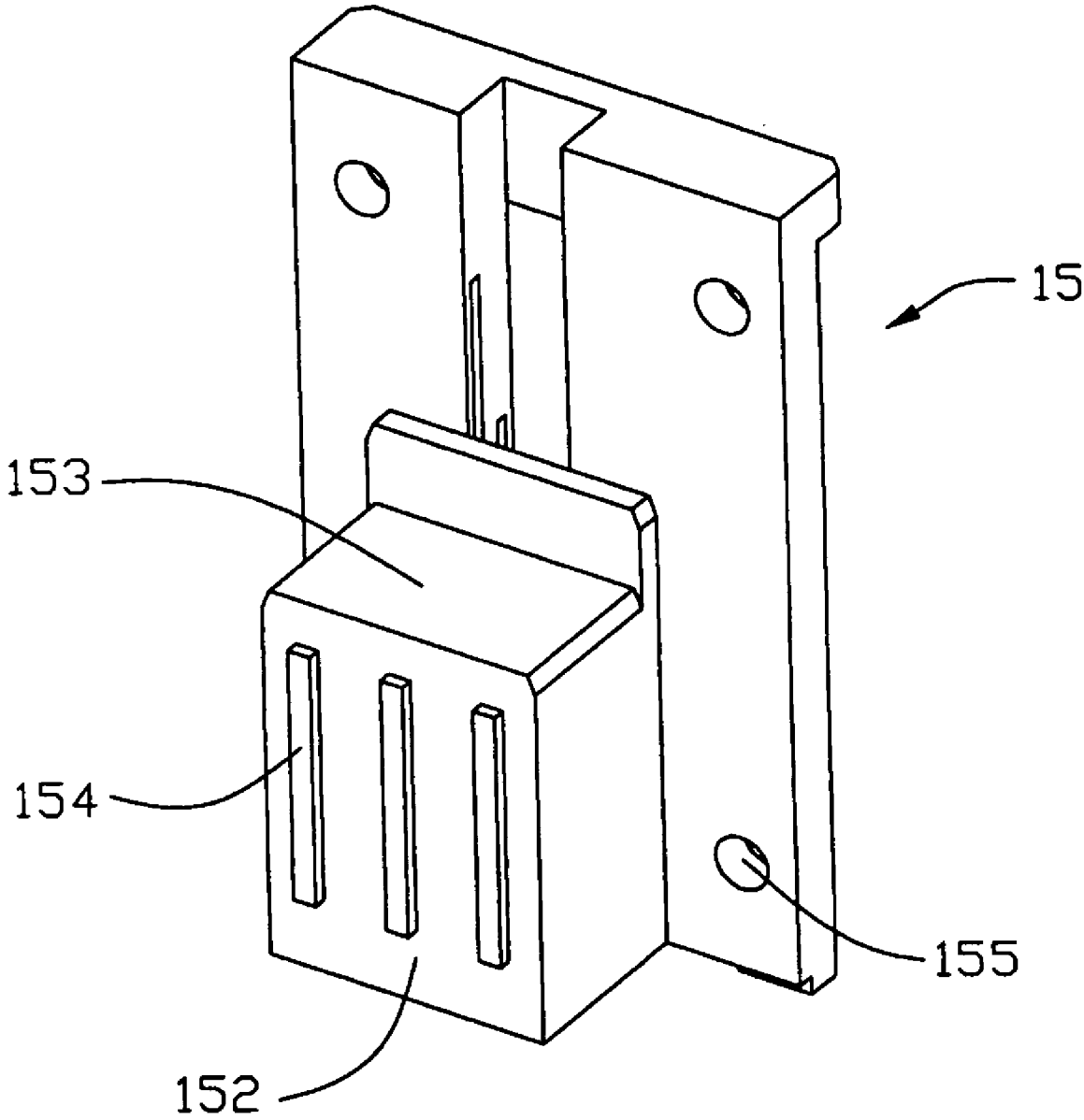
FIG. 5 is a perspective view of the spacer of FIG. 4.

With reference to FIGS. 1–5, an electrical connector in accordance with the present invention is a straight-shaped jack connector 1 and comprises an insulating housing 10, a plurality of different contacts 20, and an optical device 30.

The insulative housing 10 is straight-shaped and comprises a mating portion 11, a mounting portion 12, and opposite side portions 13 connecting the mating and mounting portion 11, 12, a cavity space 14, and a spacer 15 installed in a rear end of the insulative housing 10. The side portions 13 and the spacer 15 define a plurality of passageways 16 receiving the contacts 20.

The mating portion 11 of the insulative housing 10 forms a cylinder-shaped mating end 110 defining an opening 111 extending through the mating portion 11 and communicating with the cavity space 14. The opening 111 mates with an audio or optical fiber mating plug connector (not shown) for transmitting signals. The cavity space 14 of the insulative housing 10 divides into two parts by a partition 17. A first part 140 is above the partition 17, and a second part 141 is below the partition 17.

The partition 17 comprises an upper and a lower surfaces 170, 171 and an optical hole 172 extending through the upper and lower surfaces 170, 171. The optical hole 172 has a funnel-shaped portion 173 at a top end thereof for receiving the audio plug connector. The optical hole 172, the funnel-shaped portion 173, and the opening 111 of the mating end 110 have same axis.

The contacts 20 are installed in the passageways 16 of the insulative housing 10. The contacts include three elastic contacts 21, 22, 23, and a fixed contact 24. The three elastic contacts 21, 22, 23 are assembled into the side portions 13 and the spacer 15 respectively. The fixed contact 24 is assembled to the spacer 15 and contacts the elastic contact 22. Upper ends (not labeled) of the three elastic contacts 21, 22, 23 extend into the first part 140 and tail ends (not labeled) are soldered to a printed circuit board (not shown).

The spacer 15 comprises an inner wall 150 facing the cavity space 14 and a T-shaped outer wall 151. A supporting body 152 formed at the inner wall 150 accommodates the optical device 30 thereon. The optical device 30 comprises an engaging portion 31 positioned in a top surface 153 of the supporting body, and a plurality of tail portion 32 extending downwardly along corresponding ribs 154 of the supporting body 152. Four apertures 155 are defined at apposite sides and extend through the inner and the outer walls 150, 151 of the spacer 15. The apertures 155 respectively mate with corresponding guiding posts 18 of insulative housing 10. The spacer 15 connects the insulative housing 10 securely by heating the optical apertures 155 and the guiding posts 18. When the spacer is assembled to the insulative housing 10, the supporting body 152 extends into the second part 141. The engaging portion 31 of the optical device 30 is below the optical hole 172 and adjacent to the partition 17, and the tail portions 32 fixed on the corresponding ribs 154 mates with corresponding recesses 19 of the insulative housing 10. The tail portions 32 extend outside of the bottom surface (not labeled) and are soldered to the PCB.

A metal shielding 40 encloses the insulative housing 10. When a general plug connector (audio plug connector) is inserted into the opening 111 of the mating end 110, the general plug extends into the first part 140 and contacts the elastic contacts 21, 22, 23 for an electrical connection. Due to the funnel-shaped portion 173 of the partition 17 which has a larger diameter at an upper end adjacent to and communicating with the first part 140, and a smaller diameter at a lower end adjacent to the and communication with the second part 141, the general plug just can be inserted into the front end of the funnel-shaped portion 173 and received in the first part 140. When an optical fiber plug connector is inserted into the funnel-shaped portion 173, the optical fiber plug connector extends through the funnel-shaped portions 173 and enters the first and second parts 140, 141. Finally, the optical plug connector rests in the second part 141 and contacts the engaging portion 31 of the optical device 30 for transmitting signals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A jack connector comprising:

an insulative housing comprising a mating portion, a mounting portion, side portions, and a cavity space, the mating portion defining an opening extending therethrough and communicating with the cavity space;

a plurality of contacts retained in the insulative housing, each contact having an upper end received in the cavity space and a tail end;

an optical device installed in the insulative housing and having an engaging portion for contacting an optical fiber plug connector, and a number of tail portions, a first distance between the engaging portion and the mating portion is longer than a second distance between the upper end of the contact and the mating portion, wherein the cavity space includes a first part proximal to the mating portion and a second part distal from the mating portion, the upper end of the contact is received in the first part, and the engaging portion of the optical device is received in the second part;

wherein a partition is positioned in the cavity space to divide the cavity space into the first and second parts; and wherein the partition defines an optical hole for mating with the optical fiber plug connector, the optical hole mid the opening of the mating portion having same axis.

2. The jack connector as described in claim 1, wherein the partition defines an optical hole for mating with the optical fiber plug, the optical hole and the opening of the mating portion having some axis.

3. The jack connector as described in claim 1, wherein a removable spacer is assembled to a longitudinal side of the insulative housing, and has a supporting body in an inner surface thereof connecting with the optical device.

4. The jack connector as disclosed in claim 3, wherein the second part of the cavity space receives the supporting body.

5. The jack connector as disclosed in claim 3, wherein the engaging portion of the optical device connects with a top surface of the supporting body, and the tail portions extend beyond the insulative housing.

6. The jack connector as described in claim 1, wherein the contacts include a number of elastic contacts and a fixed contact, one of the elastic contacts connecting the fixed contact, the connecting contacts of the elastic and the fixed contacts assembled to the spacer, and others elastic contacts assembled to side portions of the insulative housing.

7. The jack connector as described in claim 6, wherein the jack connector is straight-shaped.

8. A jack connector comprising:

an insulative housing comprising a mating portion, a mounting portion, side portions, and a cavity space, the mating portion defining an opening extending therethrongh and communicating with the cavity space;

a plurality of contacts retained in the insulative housing, each contact having an upper end received in the cavity space and a tail end;

an optical device installed in the insulative housing and having an engaging portion for contacting an optical fiber plug connector, and a number of tail portions, a first distance between the engaging portion and the mating portion is longer than a second distance between the upper end of the contact and the mating portion, wherein a removable spacer is assembled to a longitudinal side of the insulative housing, and has a supporting body in an inner surface thereof connecting with the optical device.

* * * * *